US008875422B2

(12) United States Patent
Tanaka et al.

(10) Patent No.: US 8,875,422 B2
(45) Date of Patent: Nov. 4, 2014

(54) EXCAVATING BUCKET FOR CONSTRUCTION MACHINE

(71) Applicant: Komatsu Ltd., Tokyo (JP)

(72) Inventors: Daijirou Tanaka, Hirakata (JP); Daijirou Itou, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/004,510

(22) PCT Filed: Dec. 21, 2012

(86) PCT No.: PCT/JP2012/083362
§ 371 (c)(1),
(2), (4) Date: Sep. 11, 2013

(87) PCT Pub. No.: WO2013/179521
PCT Pub. Date: Dec. 5, 2013

(65) Prior Publication Data

US 2014/0059900 A1 Mar. 6, 2014

(30) Foreign Application Priority Data

May 29, 2012 (JP) ..... 2012-121989

(51) Int. Cl.
*E02F 3/40* (2006.01)
*E02F 9/28* (2006.01)
*E02F 9/00* (2006.01)

(52) U.S. Cl.
CPC ..... *E02F 9/2816* (2013.01); *E02F 3/40* (2013.01); *E02F 9/2883* (2013.01); *E02F 9/2825* (2013.01); *E02F 9/00* (2013.01)
USPC ..... 37/444

(58) Field of Classification Search
USPC ..... 37/339, 341, 379, 398, 411, 443, 444, 37/452–460, 465, 244, 266; 172/701.1–701.3, 811–815, 824, 825, 172/784; 414/722–724
See application file for complete search history.

(56) References Cited

U.S. PATENT DOCUMENTS

| | | | | | |
|---|---|---|---|---|---|
| 4,077,140 | A * | 3/1978 | Branconi | 37/443 |
| 5,040,900 | A * | 8/1991 | Boggs | 366/348 |
| 5,172,498 | A * | 12/1992 | Wack | 37/443 |
| 6,108,951 | A * | 8/2000 | Renfrow et al. | 37/468 |
| 6,581,308 | B1 * | 6/2003 | Woerman et al. | 37/444 |
| 8,695,240 | B2 * | 4/2014 | Mills et al. | 37/444 |
| 2005/0268500 | A1 | 12/2005 | Imamura et al. | |

FOREIGN PATENT DOCUMENTS

| | | | |
|---|---|---|---|
| JP | 2001-342649 | A | 12/2001 |
| JP | 2007-24315 | A | 2/2007 |
| JP | 2011-58278 | A | 3/2011 |

OTHER PUBLICATIONS

International Search Report for PCT/JP2012/083362, issued on Apr. 9, 2013.

* cited by examiner

*Primary Examiner* — Robert Pezzuto
(74) *Attorney, Agent, or Firm* — Global IP Counselors, LLP

(57) ABSTRACT

An excavating bucket includes a cutting edge having inclined parts at its left and right ends, a plurality of adapters fixed to the distal end side of the cutting edge, corner adapters that are fixed to the inclined parts provided to the left and right ends on the cutting edge on the distal end side, whose distal end positions are disposed on the same line as the distal end positions of the plurality of center adapters, and that have recesses into which side plates are inserted, and joint portions where the corner adapters are joined to only the cutting edge by continuous weld.

2 Claims, 8 Drawing Sheets

(a)

(b)

EXCAVATING BUCKET FOR CONSTRUCTION MACHINE

CROSS-REFERENCE TO RELATED APPLICATIONS

This application is a U.S. National stage application of International Application No. PCT/JP2012/083362, filed on Dec. 21, 2012. This U.S. National stage application claims priority under 35 U.S.C. §119(a) to Japanese Patent Application No. 2012-121989, filed in Japan on May 29, 2012, the entire contents of which are hereby incorporated herein by reference.

FIELD OF THE INVENTION

The present invention relates to an excavating bucket for a construction machine.

DESCRIPTION OF THE RELATED ART

Various kinds of work implement are attached to a hydraulic excavator or other such construction machine according to the work to be done.

For example, with a hydraulic excavator, an excavating bucket is mounted as a work implement at the distal end of an arm. A plurality of adapters provided so as to protrude from the distal end portion are provided to the distal end portion on the excavation side of the excavating bucket. A plurality of replaceable teeth (ground engaging tools) are attached to the distal ends of these adapters. When the hydraulic excavator is used for excavation, the teeth provided at the distal ends of this bucket on the excavation side function as blades that penetrate material being excavated and enhance the digging performance.

The adapters provided at the left and right ends of bucket (corner adapters) are mounted between the bucket side plates if the bucket is to be mounted to a small or medium-size hydraulic excavator. On the other hand, if the bucket is to be mounted to a large hydraulic excavator, the excavation work is performed from a bucket wall side with a tooth mounted to the left or right end, so these teeth are attached sticking out from the side plates.

Japanese Laid-Open Patent Application 2001-342649 (laid open on Dec. 14, 2001), for example, discloses an excavating bucket having corner adapters (left and right end adapters) that are welded to the end faces of the bucket side plates and bottom plate and that spread out at the same angle as the spreading angle of the side plates. This excavating bucket is configured so that the distal ends of the corner adapter are disposed on the same line as the distal ends of the other adapters.

Japanese Laid-Open Patent Application 2011-58278 (laid open on Mar. 24, 2011) discloses an excavating bucket having corner adapters that are welded by two straps to the cutting edge and the end faces of the bucket side plates so as to mate with the cutting edge, which is attached along an extension line of the bottom plate of the bucket. With this excavating bucket, the left and right portions of the distal end of the cutting edge are inclined rearward from the middle portion, the spreading angle of the corner adapters is the same as the spreading angle of the side plates, and the left and right adapter distal ends are recessed more than the other adapter distal ends.

SUMMARY

However, the following problems were encountered with the conventional construction machine excavating buckets discussed above.

Specifically, with the construction machine excavating bucket disclosed in Japanese Laid-Open Patent Application 2001-342649 (laid open on Dec. 14, 2001), since the adapters are welded to the three sides where the left and right side plates and the bottom plate that make up the bucket intersect, the bucket structure is very strong, but it is difficult to replace adapters that have become worn.

With the construction machine excavating bucket disclosed in Japanese Laid-Open Patent Application 2011-58278 (laid open on Mar. 24, 2011), since the distal end positions of the corner adapters are recessed more than that of the other adapters, the tip positions of the teeth at the left and right ends are also recessed more than the tip positions of the other teeth, which is a problem in that it makes it harder to create a uniform cutting face (excavation surface).

It is an object of the present invention to provide an excavating bucket for a construction machine, with which the distal end positions of the left and right corner adapters are on the same line as the distal end positions of the other adapters, while worn out adapters can be easily replaced.

The excavating bucket for a construction machine pertaining to the first invention comprises a bottom plate, a pair of left and right side plates, a cutting edge, a plurality of adapters, a pair of left and right corner adapters, and joint portions. The bottom plate curves in a C shape. The pair of left and right side plates, along with the bottom plate, form a box structure having a bottom part and an opening, and are attached so as to spread out toward the opening at a first angle with respect to the center line of the bottom plate in the width direction. The cutting edge is attached to the distal end portion of the bottom plate on the excavation side, and has inclined parts at the left and right ends that are inclined toward the bottom part at the first angle. The plurality of adapters are fixed to the distal end side of the cutting edge, and to their distal ends are attached excavating tooth members. The pair of left and right corner adapters are fixed to the inclined parts provided to the left and right ends on the distal end side of the cutting edge, to their distal ends are attached excavating tooth members, their distal end position is disposed on the same line as the distal end position of the plurality of adapters, and they have recesses into which the side plates are inserted. The joint portions are where the corner adapters are joined to only the cutting edge by continuous weld.

Here, with an excavating bucket used an a work implement on a hydraulic excavator or other such construction machine, for example, of the plurality of adapters that are attached to the cutting edge provided on the distal end side at the excavation side of the bottom plate that makes up the box shape of the bucket, the corner adapters attached to the inclined parts formed at the left and right ends of the cutting edge are fixed as follows.

Specifically, with this excavating bucket, the corner adapters are fixed by weld to only the cutting edge in a state in which the side plates have been inserted into the recessed part of a portion that branches in two. Also, the corner adapters are attached to the inclined parts of the cutting edge so that the tooth members at both ends spread out at a first angle, but the distal end portions are formed slightly longer than the other adapters so that the distal end position is disposed on the same line as the distal end position of the other adapters.

Consequently, by having the positions of the distal ends of the corner adapter and the plurality of other adapters on the same line, even though common tooth members are mounted on the various adapters, a uniform excavation surface can be formed, which makes the excavation work easier. Also, because the corner adapters are welded only to the cutting edge, and not to the side plates that form the box structure of the excavating bucket, the job of replacing corner adapters that are worn out, etc., can be carried out more easily than in the past.

The excavating bucket for a construction machine pertaining to the second invention is the excavating bucket for a construction machine pertaining to the first invention, wherein the joint portions are each constituted by a first joint section where the upper face of the cutting edge and the corner adapters are joined by continuous weld, and a second joint section where the lower face of the cutting edge and the corner adapters are joined by continuous weld.

Here, welds (first and second joint sections) provided to the upper and lower faces are used as joint portions where the cutting edge and the pair of left and right corner adapters are joined by weld.

Consequently, the corner adapters are welded at fewer places, so the job of replacing worn out adapters can be carried out more easily.

With the excavating bucket for a construction machine pertaining to the present invention, the distal end positions of the left and right corner adapters are on the same line as the distal end positions of the other adapters, while worn out adapters can be easily replaced.

DETAILED DESCRIPTION OF THE INVENTION

The construction machine excavating bucket 10 pertaining to an embodiment of the present invention will be described through reference to FIGS. 1 to 8.

The "left and right direction" that appears in the following description refers to the direction of an uncurved side of the bottom plate 11 of the excavating bucket 10, that is, to the direction of the side on which the adapters are mounted. The left and right direction is the width direction of the excavating bucket 10 and the bottom plate 11.

Structure of Excavating Bucket 10

Figure 1:
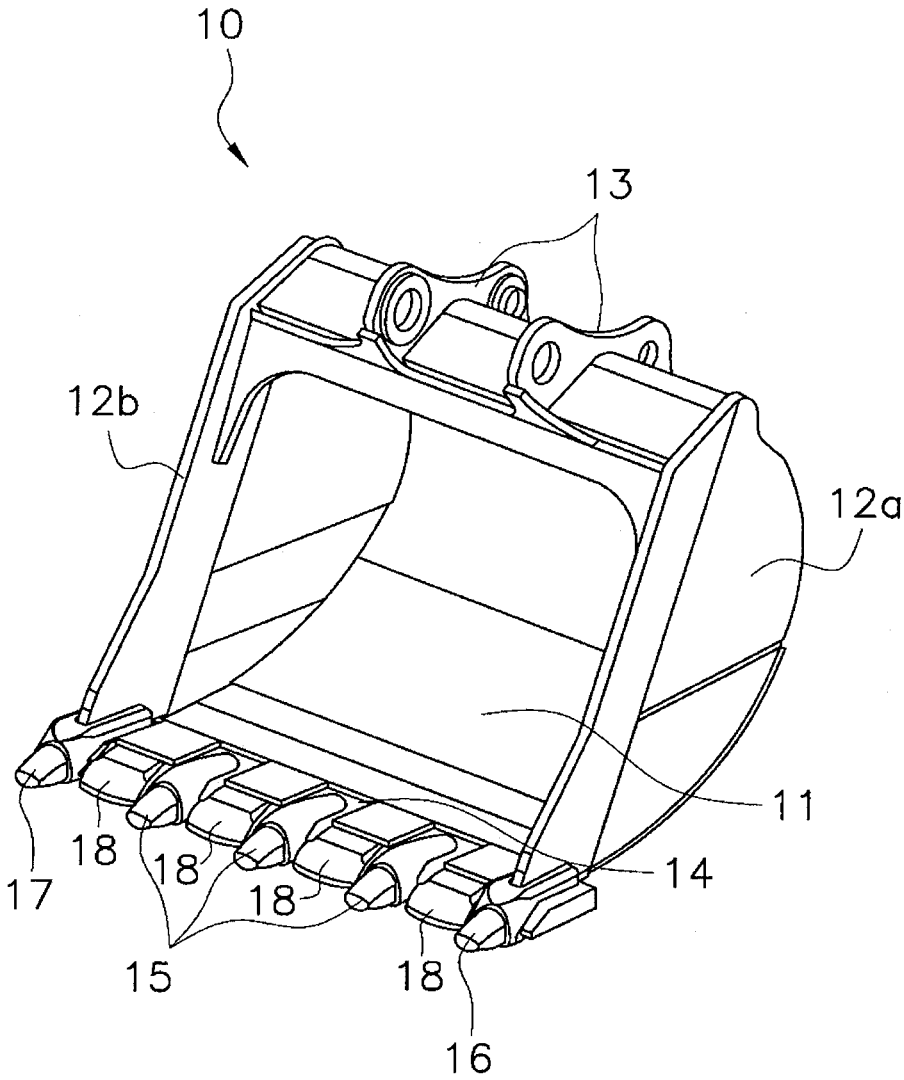
FIG. 1 is an overall oblique view of the configuration of an excavating bucket for a construction machine pertaining to an embodiment of the present invention.

The excavating bucket 10 in this embodiment is an excavating work implement driven by a hydraulic cylinder and mounted to the distal end of the arm on a hydraulic excavator or other such construction machine, and as shown in FIG. 1, comprises the bottom plate 11, a pair of left and right side plates 12*a* and 12*b*, a mounting portion 13, a cutting edge 14, center adapters 15, corner adapters 16 and 17, and shrouds 18.

The bottom plate 11 is a flat member that forms the bottom face of the box structure of the excavating bucket 10 along with the left and right side plates 12*a* and 12*b*, and is curved in a C shape toward the back of the box structure. One end of the curved shape of the bottom plate 11 is on the excavation side, and the other end is on the side mounted to the arm. These two ends of the bottom plate 11 have a linear shape. The length of these two ends is less than the length of the curved section. The bottom plate 11 as a plurality of center adapters 15 and the corner adapters 16 and 17 (discussed below) provided at the end on the excavation side. The arm mounting portion 13 is provided on the outside of the box structure at the end of the bottom plate 11 on the mounting side. The bottom plate 11 has a center line 19 defined as the center in the left and right direction (the short direction).

Figure 2:
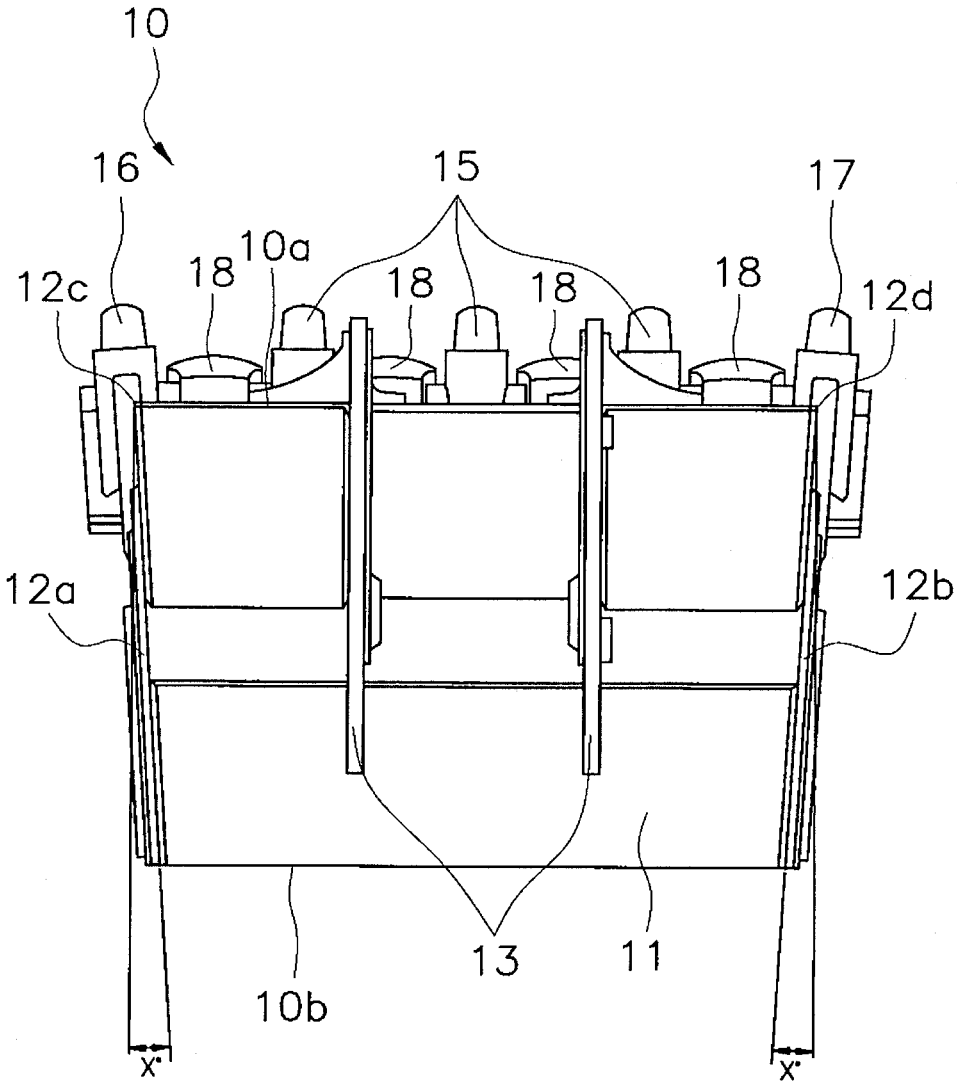
FIG. 2 is a rear view of the excavating bucket in FIG. 1, as seen from the mounting portion side (roughly upward)

The side plates 12*a* and 12*b* are flat members provided to the curved bottom plate 11 so as to block the sides on the left and right, and form the box structure along with the bottom plate 11. As shown in FIG. 2, the side plates 12*a* and 12*b* spread out at a specific angle (first angle) X° with respect to the direction in which they are parallel to each other, so that the opening of the box structure widens from the back toward the excavation side. The ends 12*c* and 12*d* of the side plates 12*a* and 12*b* that form the opening of the above-mentioned box structure are disposed parallel to each other. In other words, as shown in FIG. 2, the excavating bucket 10 has a trapezoidal shape in which the opening is rectangular and the upper side of the bucket opening 10*a* in a rear view of the bottom plate 11 is longer than the lower side of the bucket bottom part 10*b*.

Here, the spreading shape of the excavating bucket 10 is used to help break up soil inside the bucket, particularly with an excavating bucket mounted to a large hydraulic excavator or the like.

In this embodiment, the specific angle X° is set to 3.5°, but this is not the only option.

The mounting portion 13 is provided on the opposite side of the bottom plate 11 from the excavation side, and when the excavating bucket 10 is mounted to the distal end of the arm on a hydraulic excavator or the like, and is supported pivotably with respect to the arm distal end. This allows the portion of the excavating bucket 10 pivotably supported on the arm distal end to be rotated around the center by the driving force of the hydraulic cylinder.

Figure 3:
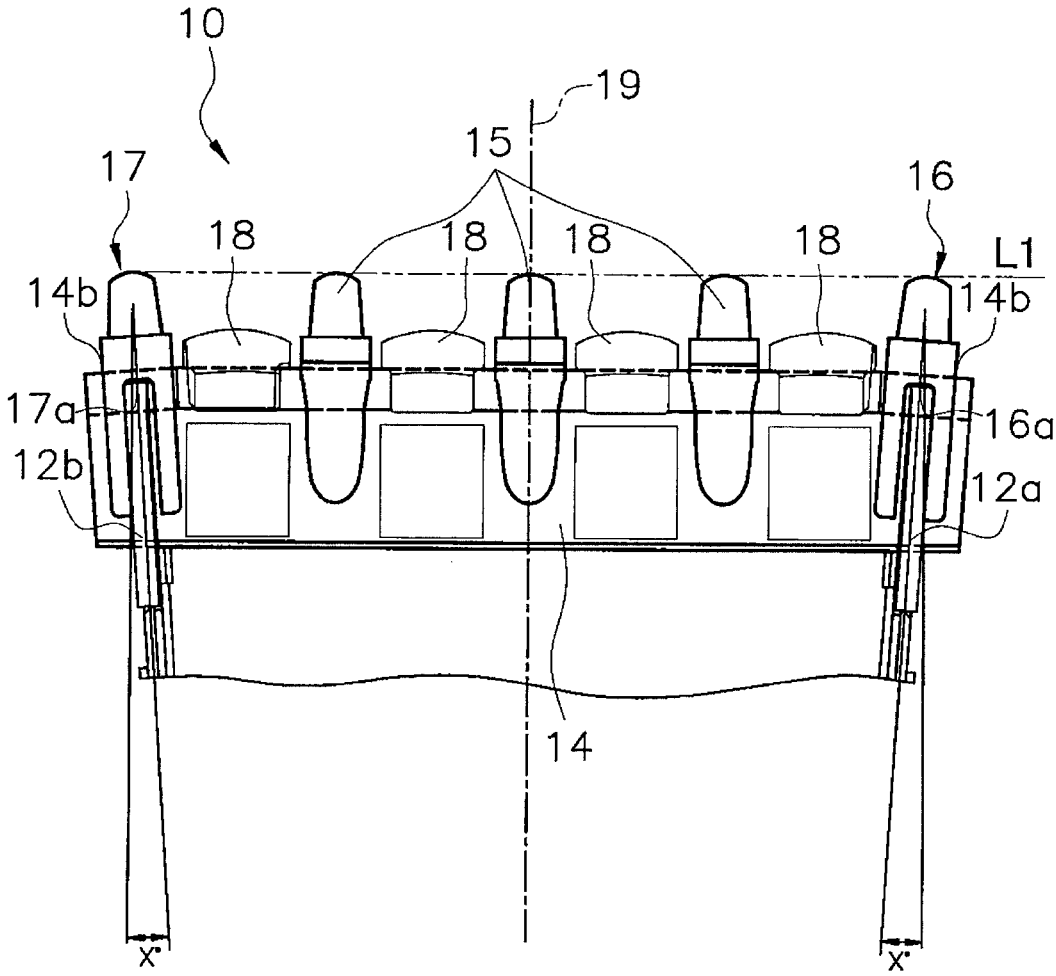
FIG. 3 is a diagram of the area around the adapters, in which the area around the mounting portion has been removed from the rear view of the excavating bucket in FIG. 2.
Figure 4:
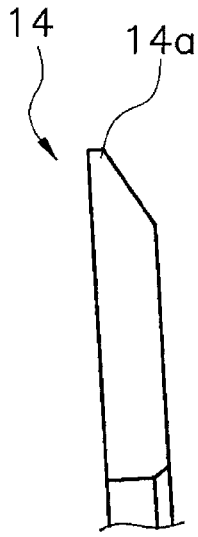
FIGS. 4*a* and 4*b* are a side view and a plan view of the cutting edge included in the excavating bucket in FIG. 1.
Figure 4:
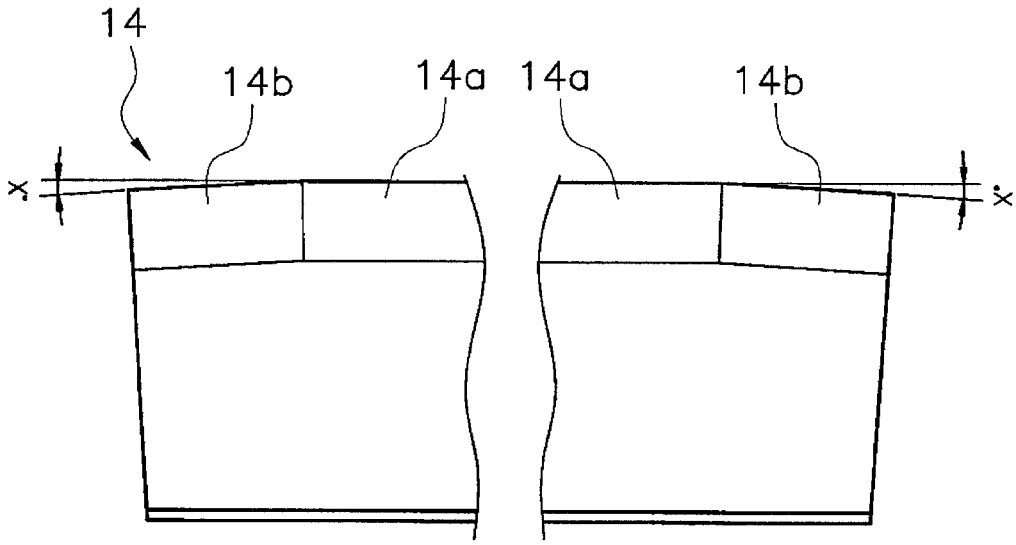

As shown in FIG. 3, the cutting edge 14 is a single flat member provided to the distal end of the bottom plate 11 on the excavation side, and as shown in FIG. 4*a*, has a wedge-shaped cross section that narrows toward the distal end on the excavation side. As shown in FIG. 4*b*, the cutting edge 14 has a distal end part 14*a* and inclined parts 14*b* to the left and right of the distal end part 14*a*, at the distal end portion on the excavation side (wedge-shaped). The cutting edge 14 is cut out from a plate material, and is welded to the bottom plate 11. The cutting edge 14 may also be made by weld together a number of members (such as a member including the distal end part 14*a* and members including the inclined parts 14*b*).

As shown in FIG. 3, the distal end part 14*a* is a distal end part that is linear in the left and right direction and is formed in the approximate center portion on the excavation side, and to this are attached a plurality of center adapters 15 (discussed below).

As shown in FIG. 4*b*, the inclined parts 14*b* are distal end portions formed so as to angle downward toward the left and right ends of the cutting edge 14 and so as to be adjacent to the distal end part 14*a*, and to these are attached the left and right corner adapters 16 and 17 (discussed below). The inclination angle of the distal ends of these inclined parts 14*b* is an angle with respect to an extension of the straight line of the distal end of the distal end part 14*a*, and is formed so as to substantially coincide with the above-mentioned specific angle X°. Consequently, the corner adapters 16 and 17 can be spread out to match the specific angle X°, which spreads out from the left and right side plates 12*a* and 12*b*, merely by attaching the corner adapters 16 and 17 to the inclined parts 14*b* of the cutting edge 14. The left and right ends of the inclined parts 14*b* on the sides not adjacent to the distal end part 14*a* are substantially parallel to the side plates 12*a* and 12*b* in the rear view shown in FIG. 3.

Excavating tooth members (not shown) are attached to the distal end parts of the center adapters 15 and the corner adapters 16 and 17. These tooth members are consumable parts that wear down during excavation work, etc., so they are attached interchangeably via pins or the like to the center adapters 15 and the corner adapters 16 and 17.

Figure 5:
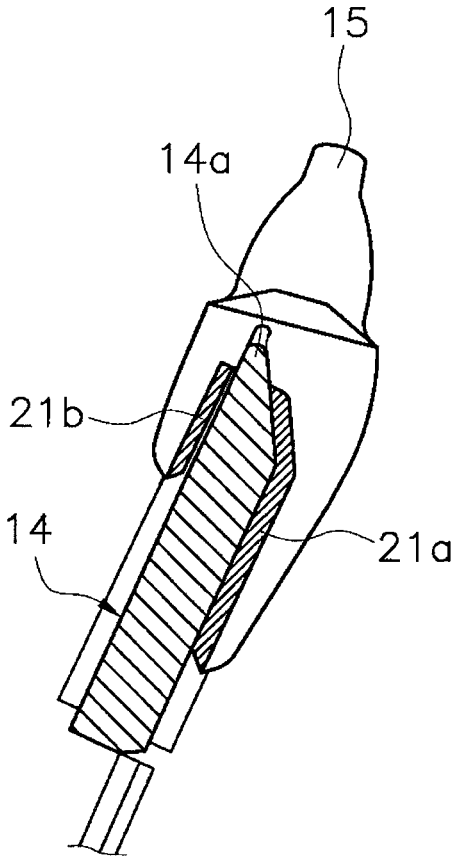
FIG. 5 is a cross section of the configuration of a center adapter included in the excavating bucket in FIG. 1.

The center adapters 15 are a plurality of adapter members obtained by excluding the corner adapters 16 and 17 attached to the left and right ends (discussed below) from the plurality of adapter members attached to the distal end of the cutting edge 14 on the excavation side. As shown in FIG. 5, the center adapters 15 are continuously welded to the cutting edge 14 at joints 21*a* (examples of joint portions) on the upper face side of the cutting edge 14 and joints 21*b* on the lower face side, so as to sandwich the distal end portion of the cutting edge 14 on the excavation side.

As shown in FIG. 3, etc., the corner adapters 16 and 17 are mounted to the left and right ends, out of the plurality of adapter members attached to the distal end of the cutting edge 14 on the excavation side. That is, the corner adapters 16 and 17 are attached to the inclined parts 14*b* provided to the left and right ends of the cutting edge 14. Accordingly, the corner adapters 16 and 17 are attached in a state of being spread out by the angle at which the inclined parts 14*b* are inclined with respect to the extension line of the distal end part 14*a*.

Also, the corner adapters 16 and 17 are disposed so as to stick out beyond the left and right side plates 12*a* and 12*b*, as shown in FIG. 2, etc., in order to use the tooth members at the left and right ends to perform excavation work on a wall face with the excavating bucket mounted to a large hydraulic excavator or the like. In other words, the corner adapters 16 and 17 are attached to portions where the side plates 12*a* and 12*b* and the cutting edge 14 (bottom plate 11) intersect each other. Therefore, as shown in FIG. 3, the corner adapters 16 and 17 respectively have recesses 16*a* and 17*a* into which the side plates 12*a* and 12*b* are inserted in an attached state.

Figure 6:
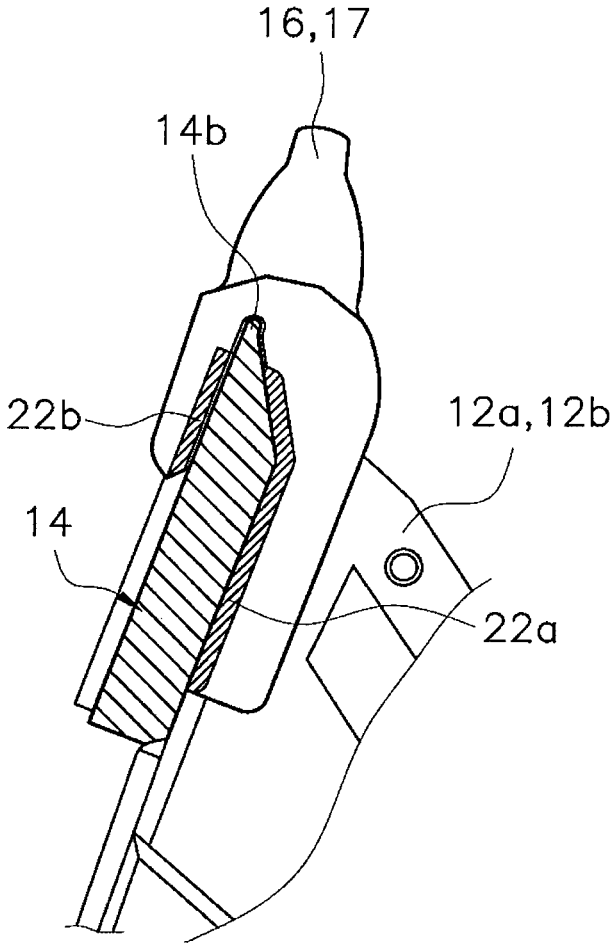
FIG. 6 is a cross section of the configuration of a center adapter included in the excavating bucket in FIG. 1.

That is, the corner adapters 16 and 17 are respectively welded via joints 22*a* and 22*b* (examples of first and second joint sections) to the upper and lower face sides of the cutting edge 14 as shown in FIG. 6 in a state in which the side plates 12*a* and 12*b* are respectively inserted into the recesses 16*a* and 17*a* formed in the center of a portion branching in two.

Figure 7:
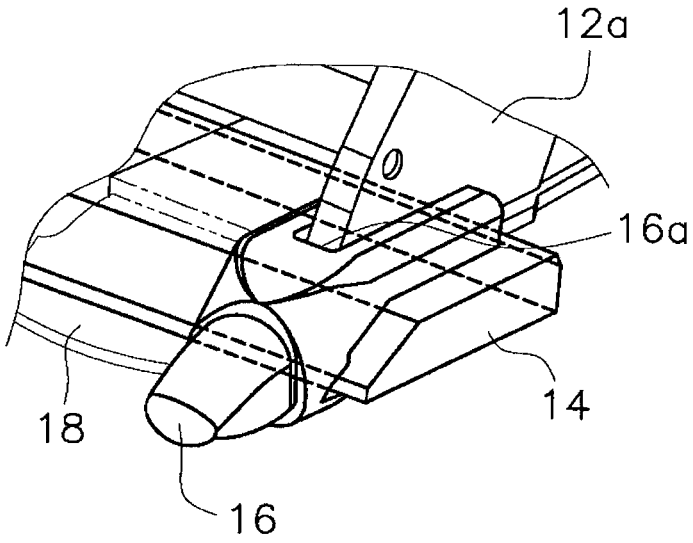
FIG. 7 is an oblique view of the configuration of the area around the right corner adapter included in the excavating bucket in FIG. 1.

More specifically, as shown in FIG. 7, the corner adapter 16 disposed at the right end of the excavating bucket 10 is provided to the portion where the right side plate 12*a* and the cutting edge 14 intersect, and is attached so that the side plate 12*a* is inserted into the recess 16*a* formed in the center between the two branches, and the cutting edge 14 is sandwiched. As shown in FIG. 6, the corner adapter 16 here is not welded to the side plate 12*a*, and is welded only to the upper and lower faces of the cutting edge 14.

Figure 8:
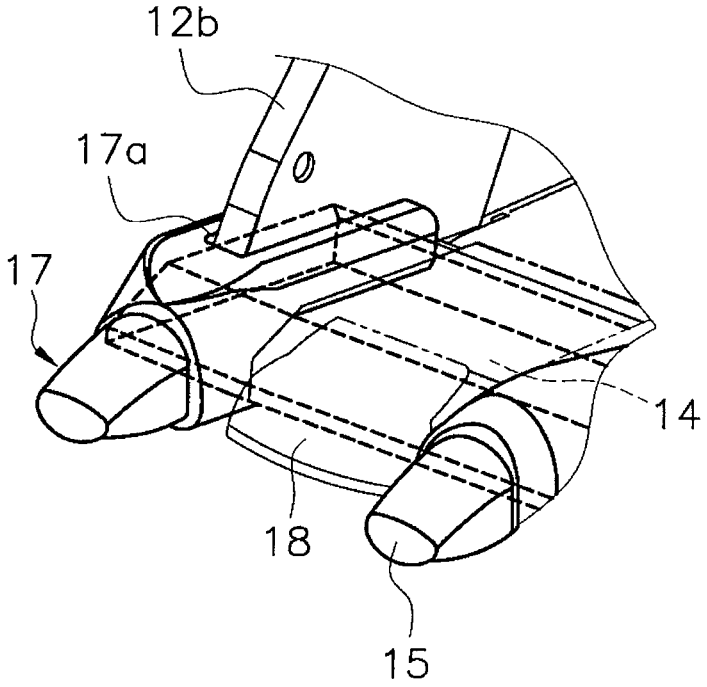
FIG. 8 is an oblique view of the configuration of the area around the left corner adapter included in the excavating bucket in FIG. 1.

As shown in FIG. 8, meanwhile, the corner adapter 17 disposed at the left end of the excavating bucket 10 is provided to the portion where the left side plate 12*b* and the cutting edge 14 intersect, and is attached so that the side plate 12*b* is inserted into the recess 17*a* formed in the center between the two branches, and the cutting edge 14 is sandwiched. As shown in FIG. 6, the corner adapter 17 here is not welded to the side plate 12*b*, and is only welded to the upper and lower faces of the cutting edge 14.

With the excavating bucket 10 in this embodiment, since the left and right side plates 12*a* and 12*b* are directly welded to the cutting edge 14 at the portion where the side plates 12*a* and 12*b* and the cutting edge 14 intersect, the corner adapters 16 and 17 do not function as strength members for ensuring the stiffness of the excavating bucket 10. Thus, there is no need to use the corner adapters as part of the strength members of the excavating bucket, as was the case with a conventional configuration in which the corner adapters and the side plates were welded together. As a result, with the configuration in this embodiment, adequate stiffness of the excavating bucket 10 can be ensured merely by weld the corner adapters 16 and 17 to just the cutting edge 14, rather than welding them to the side plates 12*a* and 12*b*.

As shown in FIG. 3 and elsewhere, the shrouds 18 are provided between the center adapters 15 and between the left and right corner adapters 16 and 17 and the center adapters 15, and are welded to the distal end portion on the excavation side of the cutting edge 14, just as with the adapters 15, 16, and 17.

As discussed above, the corner adapters 16 and 17 are attached to the inclined parts 14*b* provided to the left and right ends of the cutting edge 14. Accordingly, if adapters of the same length as the center adapters 15 were used as corner adapters, the position of the corner adapter distal ends would end up being at a position that is retracted from the line on the excavation side, by the amount that the inclined parts 14*b* are retracted from the excavation side distal ends.

As shown in FIG. 3, with the excavating bucket 10 in this embodiment, the distal end portions of the corner adapters 16 and 17 are formed longer than the center adapters 15, so that the distal ends of the corner adapters 16 and 17 will be disposed on the same line L1 as the distal ends of the center adapters 15.

Consequently, even when the inclined parts 14*b* are provided to the left and right ends of the cutting edge 14 in order to spread out the corner adapters 16 and 17 at the left and right ends and the left and right side plates 12*a* and 12*b*, a uniform excavation surface can be formed during excavation work in a state in which shared tooth members have been mounted to the center adapters 15 and the corner adapters 16 and 17.

(1) As shown in FIG. 3, the excavating bucket 10 in this embodiment comprises the bottom plate 11 that curves in a C shape in the lengthwise direction; the pair of left and right side plates 12*a* and 12*b* that along with the bottom plate 11 form a box structure having an opening 10*a* and a bottom part 10*b*, and that are attached so as to spread out toward the opening 10*a* at a specific angle X° with respect to the center line 19 of the bottom plate 11 in the width direction; a cutting edge 14 that is attached to the distal end portion of the bottom plate 11 on the excavation side, and that has inclined parts 14*b* at the left and right ends that are inclined toward the bottom part 10*b* at the specific angle X°; and a plurality of center adapters 15 that are fixed to the distal end 14*a* of the cutting edge 14, and to the distal ends of which are attached excavating tooth members. As shown in FIGS. 7 and 8, the excavating bucket 10 also comprises a pair of left and right corner adapters 16 and 17 that are fixed to the inclined parts 14*b* provided to the left and right ends on the distal end side of the cutting edge 14, to the distal ends of which are attached excavating tooth members, whose distal end position is disposed on the same line as the distal end position of the plurality of center adapters 15, and which have recesses 16*a* and 17*a* into which the side plates 12*a* and 12*b* are inserted. As shown in FIG. 6, the excavating bucket 10 further comprises joints 22*a* and 22*b* where the corner adapters 16 and 17 are welded to only the cutting edge 14.

Consequently, with the excavating bucket 10 in this embodiment, since the distal end positions of the corner adapters 16 and 17 disposed at the left and right ends can be disposed along the same line L1 as the distal end positions of the center adapters 15, a uniform excavation surface can be formed in a state in which shared tooth members have been mounted to the adapters 15, 16, and 17.

Furthermore, with the excavating bucket 10 in this embodiment, since the corner adapters 16 and 17 are welded only to the upper and lower faces of the cutting edge 14, rather than being welded to the side plates 12*a* and 12*b*, the job of replacing the corner adapters 16 and 17 can be performed more easily than with conventional corner adapters that were welded to the side plates.

(2) As shown in FIG. 6, with the excavating bucket 10 in this embodiment, when the corner adapters 16 and 17 are welded to the upper and lower faces of the cutting edge 14, they are welded via the joints 22*a* and 22*b*.

Consequently, because the corner adapters 16 and 17 are welded to the cutting edge 14 at the minimum number of places, taking into account the load exerted on the corner adapters 16 and 17 during excavation work, etc., the replacement job can be performed more easily when the corner adapters 16 and 17 wear out.

Other Embodiments

An embodiment of the present invention was described above, but the present invention is not limited to or by the above embodiment, and various modifications are possible without departing from the gist of the invention.

(A) In the above embodiment, an example was given in which the corner adapters 16 and 17 were welded at two places: on the upper face side (joint 22*a*) and the lower face side (joint 22*b*) of the cutting edge 14, respectively. The present invention is not, however, limited to or by this.

For example, the portion of the corner adapters joined to the cutting edge is not limited to being on the upper and lower face sides, and welds may be made at other portions, such as the side faces.

(B) In the above embodiment, an example was given in which the excavating bucket 10 had three center adapters 15. The present invention is not, however, limited to or by this.

For example, the present invention can of course be applied to an excavating bucket having two center adapters 15, or one having four or more.

(C) In the above embodiment, an example was given in which the excavating bucket was mounted to the arm distal end of a hydraulic excavator. The present invention is not, however, limited to or by this.

For example, the present invention can also be applied to an excavating bucket that is mounted to some other type of construction machine.

The effect of the construction machine excavating bucket of the illustrated embodiments is that the job of replacing worn-out adapters can be easily carried out while the distal end positions of the left and right corner adapters are aligned on the same line as the distal end positions of the other adapters, which allows this invention to be widely applied to excavating buckets mounted to various kinds of construction machine.

The invention claimed is:

1. An excavating bucket for a construction machine comprising:

a bottom plate that curves in a C shape;

a pair of left and right side plates that along with the bottom plate form a box structure having a bottom part and an opening, and that are attached so as to spread out toward the opening at a first angle with respect to a center line of the bottom plate in a width direction;

a cutting edge that is attached to a distal end portion of the bottom plate on an excavation side, and that has inclined parts at the left and right ends that are inclined toward the bottom part at the first angle;

a plurality of adapters that are fixed to a distal end side of the cutting edge, with a plurality of excavating tooth members being respectively attached to distal ends the adapters of;

a pair of left and right corner adapters that are fixed to the inclined parts of the cutting edge, with a pair of excavating tooth members being respectively attached to distal ends of the left and right corner adapters, distal end positions of the left and right corner adapters being disposed on the same line as distal end positions of of the plurality of adapters, and each of the left and right corner adapters having a recess into which the side plates are respectively inserted; and joint portions where the left and right corner adapters are joined to only the cutting edge by continuous weld.

2. The excavating bucket for a construction machine according to claim 1, wherein each of the joint portions is constituted by a first joint section where an upper face of the cutting edge and a corresponding one of the left and right corner adapters are joined by continuous weld, and a second joint section where a lower face of the cutting edge and the corresponding one of the left and right corner adapters are joined by continuous weld.

* * * * *